US010857449B2

(12) United States Patent
Carroll

(10) Patent No.: US 10,857,449 B2
(45) **Date of Patent: *Dec. 8, 2020**

(54) DICE ANGLE GAME

(71) Applicant: Christopher J. Carroll, Peoria, IL (US)

(72) Inventor: Christopher J. Carroll, Peoria, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/148,712

(22) Filed: Oct. 1, 2018

(65) Prior Publication Data

US 2019/0030419 A1 Jan. 31, 2019

Related U.S. Application Data

(63) Continuation-in-part of application No. 15/458,396, filed on Mar. 14, 2017, now Pat. No. 9,993,720.

(51) Int. Cl.

| | |
|---|---|
| ***A63F 3/00*** | (2006.01) |
| ***A63F 7/00*** | (2006.01) |
| ***A63F 9/04*** | (2006.01) |
| ***A63F 7/30*** | (2006.01) |
| ***A63F 7/06*** | (2006.01) |

(Continued)

(52) U.S. Cl.

CPC ..... *A63F 3/00214* (2013.01); *A63F 3/00176* (2013.01); *A63F 3/00261* (2013.01); *A63F 3/00694* (2013.01); *A63F 7/0017* (2013.01); *A63F 7/06* (2013.01); *A63F 7/0668* (2013.01); *A63F 7/3055* (2013.01); *A63F 9/04* (2013.01); *A63F 9/0415* (2013.01); *A63B 2067/061* (2013.01); *A63B 2071/0694* (2013.01); *A63F 2003/00179* (2013.01); *A63F 2003/00182* (2013.01); *A63F 2003/00189* (2013.01); *A63F 2003/00195* (2013.01); *A63F 2003/00201* (2013.01); *A63F 2003/00205* (2013.01); *A63F 2003/00208* (2013.01); *A63F 2003/00211* (2013.01); *A63F 2003/00457* (2013.01); *A63F 2003/00473* (2013.01); *A63F 2003/00476* (2013.01); *A63F 2003/00479* (2013.01); *A63F 2003/00482* (2013.01); *A63F 2003/00545* (2013.01); *A63F 2003/00807* (2013.01); *A63F 2003/00813* (2013.01);

(Continued)

(58) Field of Classification Search

CPC .. A63F 7/30; A63F 7/36; A63F 9/0402; A63F 2007/3005; A63F 2007/3625; A63F 2003/00848; A63F 2003/00807; A63F 2003/00482; A63F 2003/00476; A63G 9/0402

See application file for complete search history.

(56) References Cited

U.S. PATENT DOCUMENTS 4,239,221 A * 12/1980 Griffin ..... A63F 9/0204 273/127 R
D294,720 S * 3/1988 MacDowell ..... D21/318

(Continued)

*Primary Examiner* — Michael D Dennis
(74) *Attorney, Agent, or Firm* — KaiderLaw; Brian D. Kaider

(57) ABSTRACT

A dice angle game is played on an apparatus that has a playing surface, at least one side wall, at least one barrier within the playing area, at least one demarcated scoring area, at least one enhanced scoring area of sufficient size for at least one die to enter, and a plurality of dice. The game is played by rolling a dice against a side wall and trying to have it land in a scoring area.

24 Claims, 9 Drawing Sheets

(51) Int. Cl.
*A63B 71/06* (2006.01)
*A63B 67/06* (2006.01)

(52) U.S. Cl.
CPC ..... *A63F 2003/00848* (2013.01); *A63F 2007/301* (2013.01); *A63F 2007/303* (2013.01); *A63F 2009/0464* (2013.01)

(56) References Cited

U.S. PATENT DOCUMENTS

| | | | | | |
|---|---|---|---|---|---|
| 5,074,556 | A * | 12/1991 | Loeppky | A63F 7/0668 | 273/108.5 |
| D347,026 | S * | 5/1994 | Young | D21/318 | |
| 7,204,457 | B2 * | 4/2007 | Ackerman | B64D 9/00 | 244/118.1 |
| D604,772 | S * | 11/2009 | Tower | D21/318 | |
| 2012/0202609 | A1 * | 8/2012 | Williams | A63D 15/00 | 473/20 |

* cited by examiner

DICE ANGLE GAME

FIELD OF THE INVENTION

This invention relates to games utilizing a board apparatus and polyhedral dice. More particularly, the invention relates to a game in which a plurality of dice are pitched in an attempt to circumnavigate barriers to land in a specific scoring region upon the board apparatus.

BACKGROUND OF THE INVENTION

Many sports and games involve pitching, throwing, sliding, or bouncing a projectile towards a scoring region identified down range from the participant throwing the projectile. Examples of such games include darts, bowling, horseshoes, bean bags (also known as cornhole), shuffle board, bocce ball, and curling.

There are many board game that simulate these well-known sports and games. Some of the games utilize dice, spinners, shuffled decks of option cards, or other random number generators to select a play option. As one example, Seitz, U.S. Pat. No. 4,501,426, Feb. 26, 1985, simulates the game of bowling in which both dice and cards are employed to select the outcome of a bowling ball rolling down a lane towards an array of pins. As a second example, Swartz, U.S. Pat. No. 5,082,288, Jan. 21, 1992, simulates the game of horseshoes in which both dice and a specialized game board are used to select the outcome of pitching a horseshoe towards a peg in the ground.

Whereas some games are based on pure chance or mental skills, games that require physical skill are more attractive to many. The requirement of physical skill makes the games attractive to those players who wish to become more proficient by repeated play. Proficiency in such games is improved through the development of accuracy, throwing style, velocity, rotation, and other techniques.

Despite the large number of board games currently available, there continues to be a demand for a new board game that requires physical skill and that rewards a player for acquiring proficiency. More particularly, there is a demand for a dice angle game in which skill is required to throw dice in such a way that they land in a scoring area.

SUMMARY OF THE INVENTION

The general object of this invention is to provide an entertaining and competitive board game that requires physical skill and that rewards a player for acquiring proficiency. A more particular object is to provide a dice angle game in which skill is required to throw dice in such a way that they land in a scoring area.

The present invention is a new board game apparatus for playing a dice angle game. The apparatus comprises: (a) a playing surface with at least one side wall at least partially enclosing the playing area with an open top; (b) at least one barrier disposed within the playing area; (c) at least one demarcated scoring area; and (d) a plurality of dice.

The board game of this invention is entertaining and competitive, requires physical skill, and rewards a player for acquiring proficiency.

DETAILED DESCRIPTION OF THE INVENTION

The following description includes exemplary embodiments of the invention. This description is not to be taken in a limiting sense, but is meant only to illustrate the general principles of the invention. Various inventive features are described below that can each be used independently or in combination.

Figure 1:
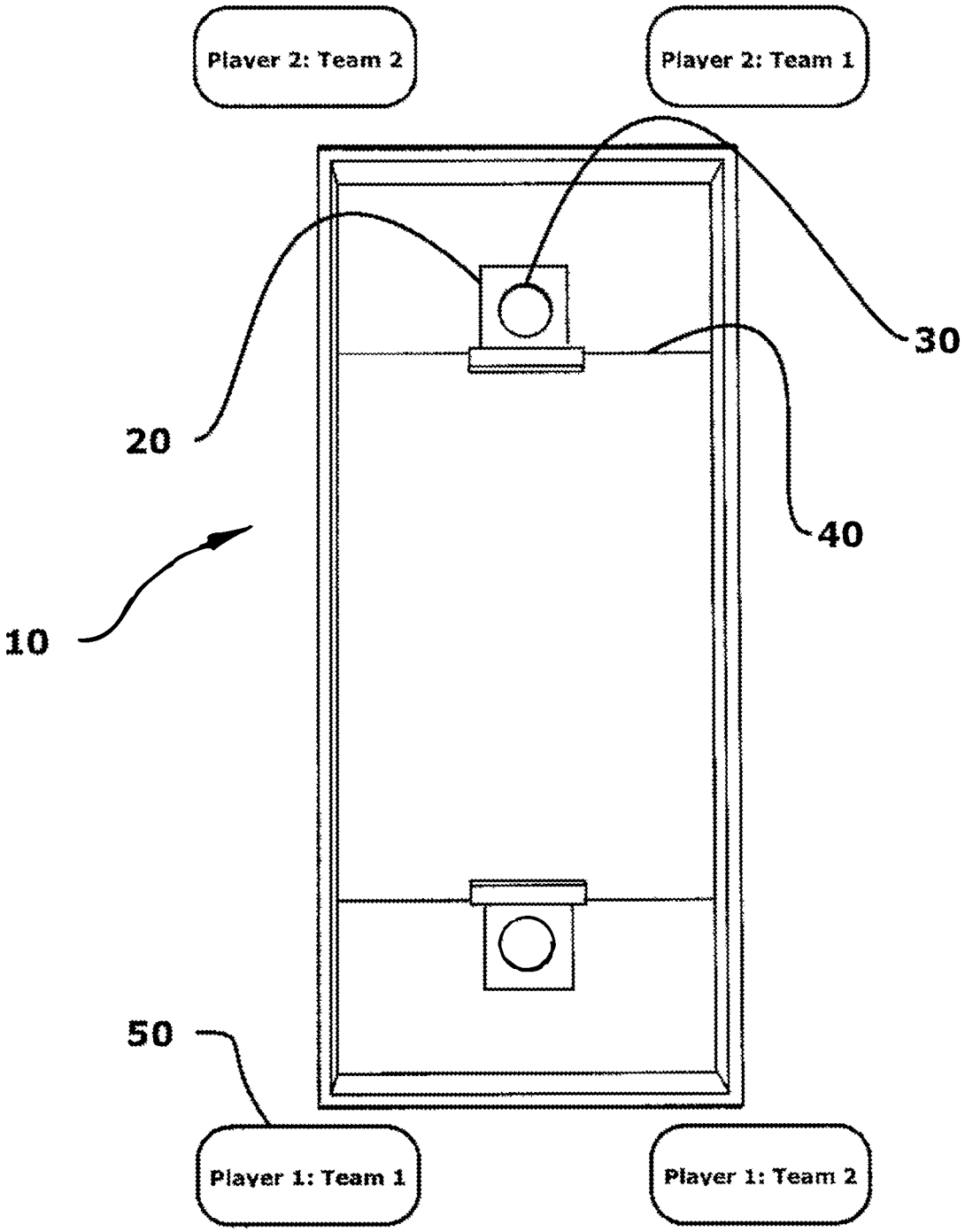
FIG. 1 is a top view of one embodiment of the board game.
Figure 2:
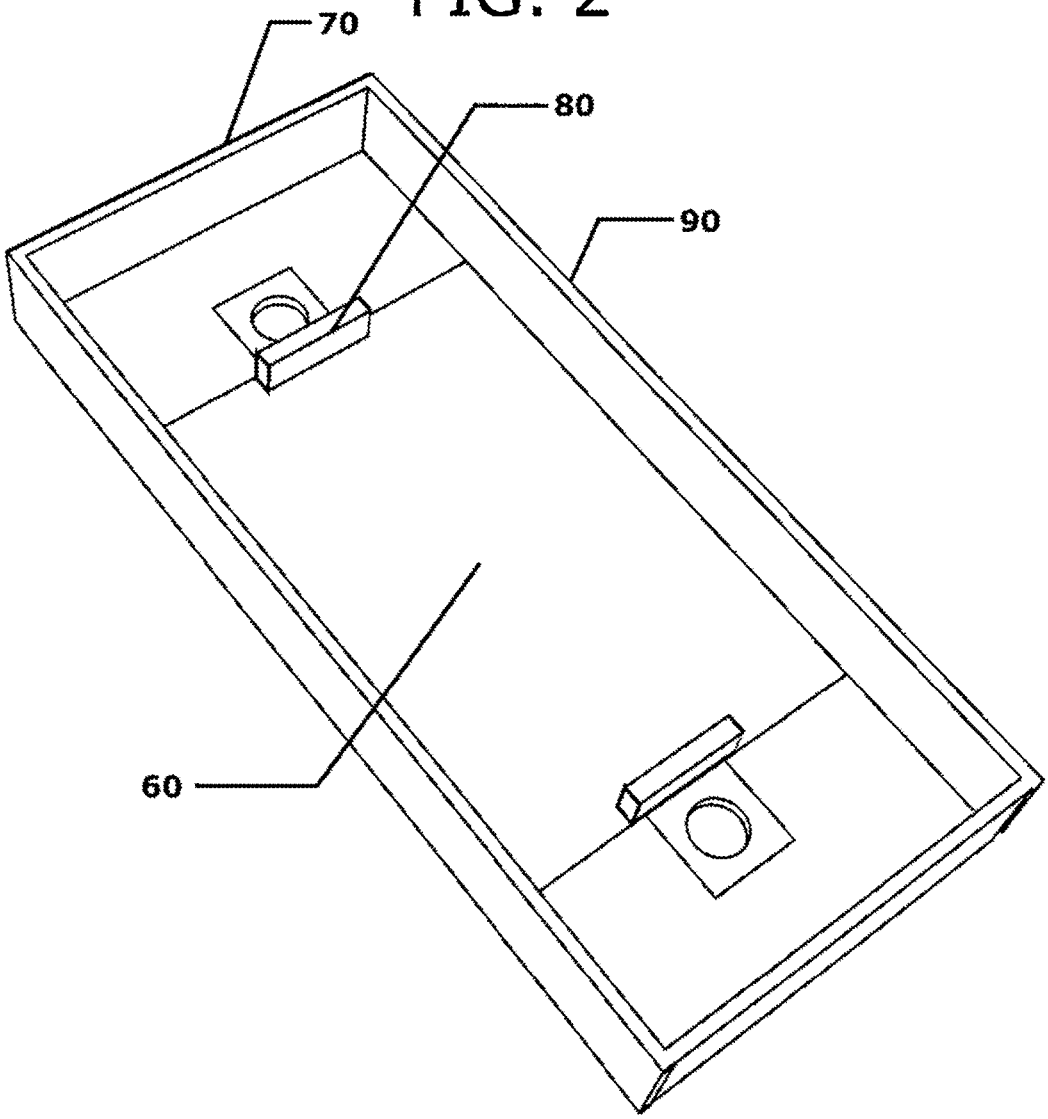
FIG. 2 is a perspective view thereof.
Figure 3:
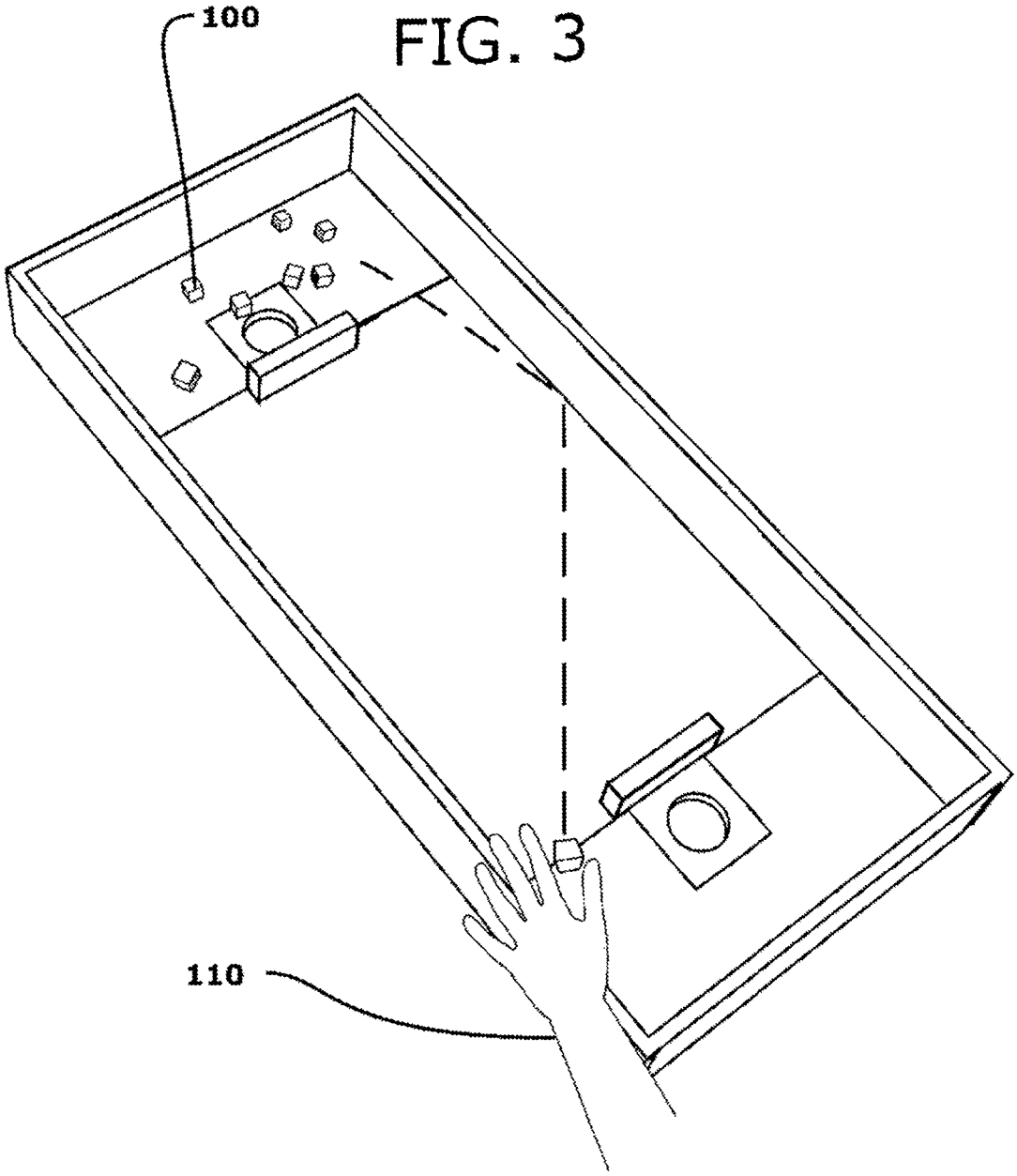
FIG. 3 is a perspective view thereof with the addition of polyhedral dice to illustrate the game play.

The invention is best understood by reference to the drawings. Referring first to the FIGS. 1 to 3, an embodiment of the board apparatus 10 of this invention comprises a rectangular playing surface 60 enclosed within two end walls 70 (also known as back walls) and two side walls 90. The apparatus 10 may take many forms, including, but not limited to: triangles, squares, rectangles, pentagons, hexagons, heptagons, octagons, nonagons, decagons, trapezoids, and quadrilaterals, all of which are encompassed by the present invention. Each of these polygons may be regular or irregular, in shape. In addition, shapes with curved walls including, but not limited to: ovals, circles, and ellipses are also suitable. The apparatus will always have at least one side wall. For example, in a circular embodiment, the apparatus will have a single side wall around the circumference of the playing surface. In embodiments where the apparatus takes the shape of a regular polygon, there will be a number of equal length side walls corresponding to the number of sides in the polygon. In embodiments where the apparatus is a rectangle, the two long sides of the rectangle will be bordered by equal length side walls and the short sides of the rectangle will be bordered by equal length end walls 70 (also known as back walls). Specific configurations of sidewalls for other embodiments will depend upon the overall configuration of the apparatus.

In one embodiment, the apparatus is about one to two feet in width and about two to six feet in length. Larger dimensions are suitable, but are often undesirable because of the storage room required. When the playing surface is rectangular, the length of the side walls are generally about two to five times the length (width) of the end walls.

Figure 5:
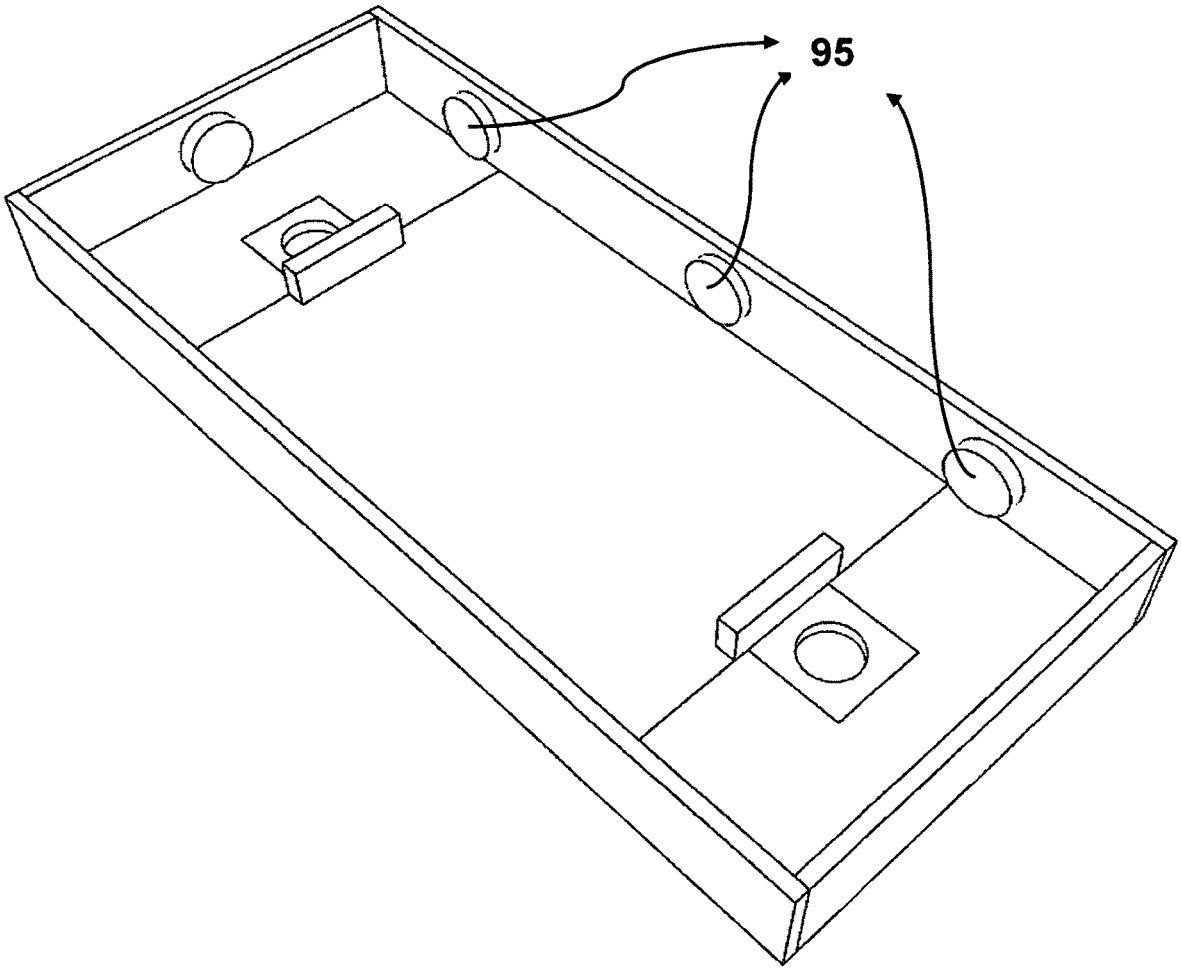
FIG. 5 is a perspective view of one embodiment of the board game, showing one embodiment of sidewall irregularities.

The playing surface 60 is preferably flat. However, uneven surfaces having undulations and the like are also suitable. The side walls may be flat, curved, or have bumps, undulations, protrusions, recesses, or barriers 95 of various shapes and dimensions (FIG. 5). The side walls should be of sufficient height to enable players to toss the dice against the side wall and keep the dice within the playing area. The side walls should be at least three inches high for this purpose.

The playing surface 60 contains at least one scoring area 20 demarcated by lines, color, or other indicia, and an enhanced scoring area 30 within each scoring area of sufficient size for at least one die to enter. The scoring area is larger than the enhanced scoring area contained therein. The enhanced scoring area may be in a variety of shapes including, but not limited to: a triangle, a square, a rectangle, a pentagon, a hexagon, a heptagon, an octagon, a nonagon, a decagon, a circle, an oval, an ellipse, a trapezoid, and a quadrilateral. The scoring area 20 and enhanced scoring area 30 may or may not lie in the same plane as the playing surface 60. In the embodiment shown, two square scoring areas 20 are located at either end of the rectangular playing surface and are in the same plane as the playing surface 60. Within each scoring area, the enhanced scoring area 30 is comprised of a circular recess. Each scoring area is protected from direct access by a barrier 80.

Figure 6:
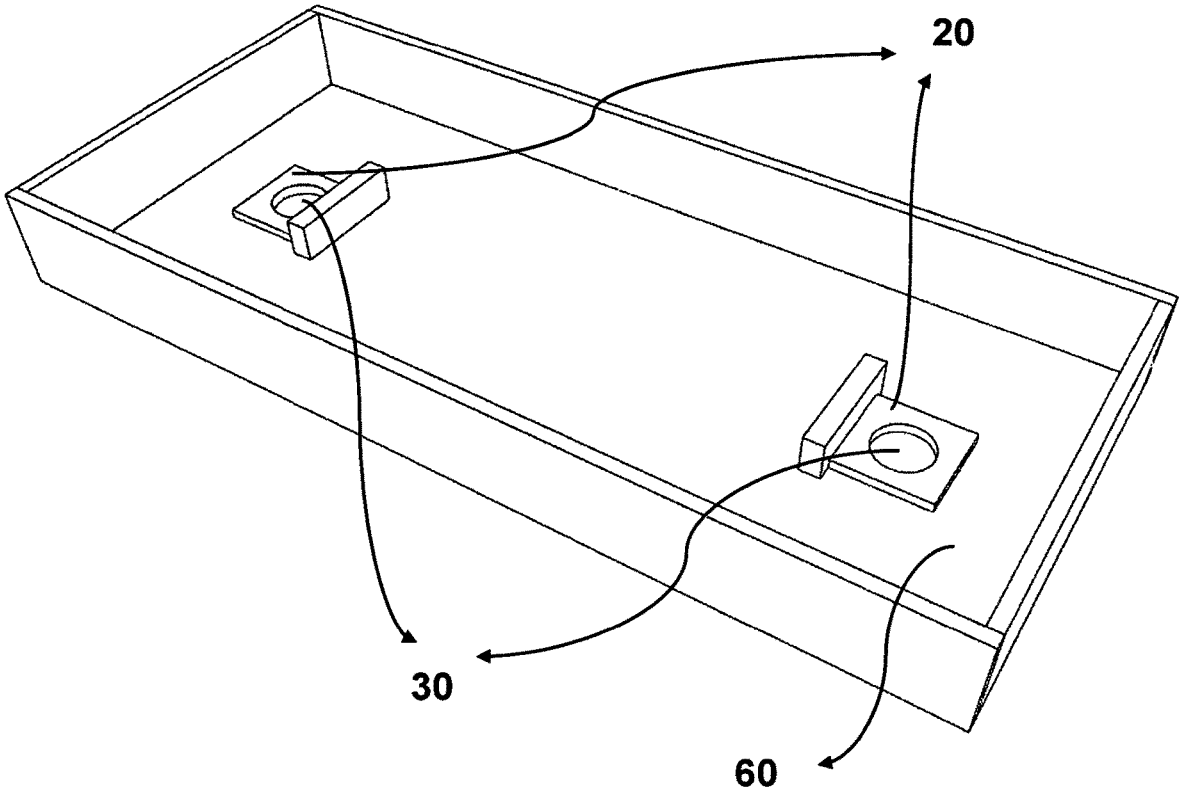
FIG. 6 is a perspective view of one embodiment of the board game, showing one embodiment of the scoring area being an elevated platform above the plane of the playing surface.

In another embodiment, as shown in FIG. 6, the scoring area 20 may be elevated above the playing surface 60, such that dice may not slide across the playing surface and into the scoring area. In such an embodiment, the enhanced scoring area 30 may be in the same plane as the scoring area 20 or may be recessed below the surface of the scoring area or further elevated above the scoring area.

Figure 7:
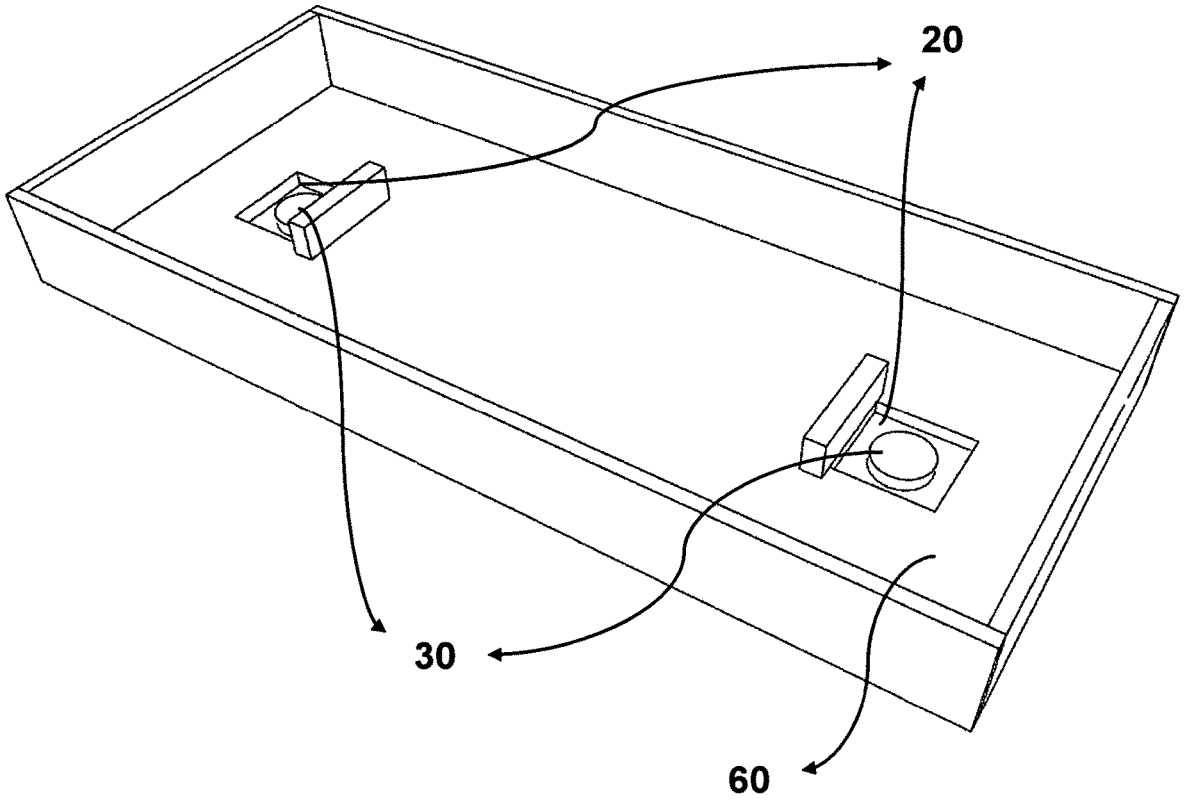
FIG. 7 is a perspective view of one embodiment of the board game, showing one embodiment of the scoring area being recessed below the plane of the playing surface.
Figure 8:
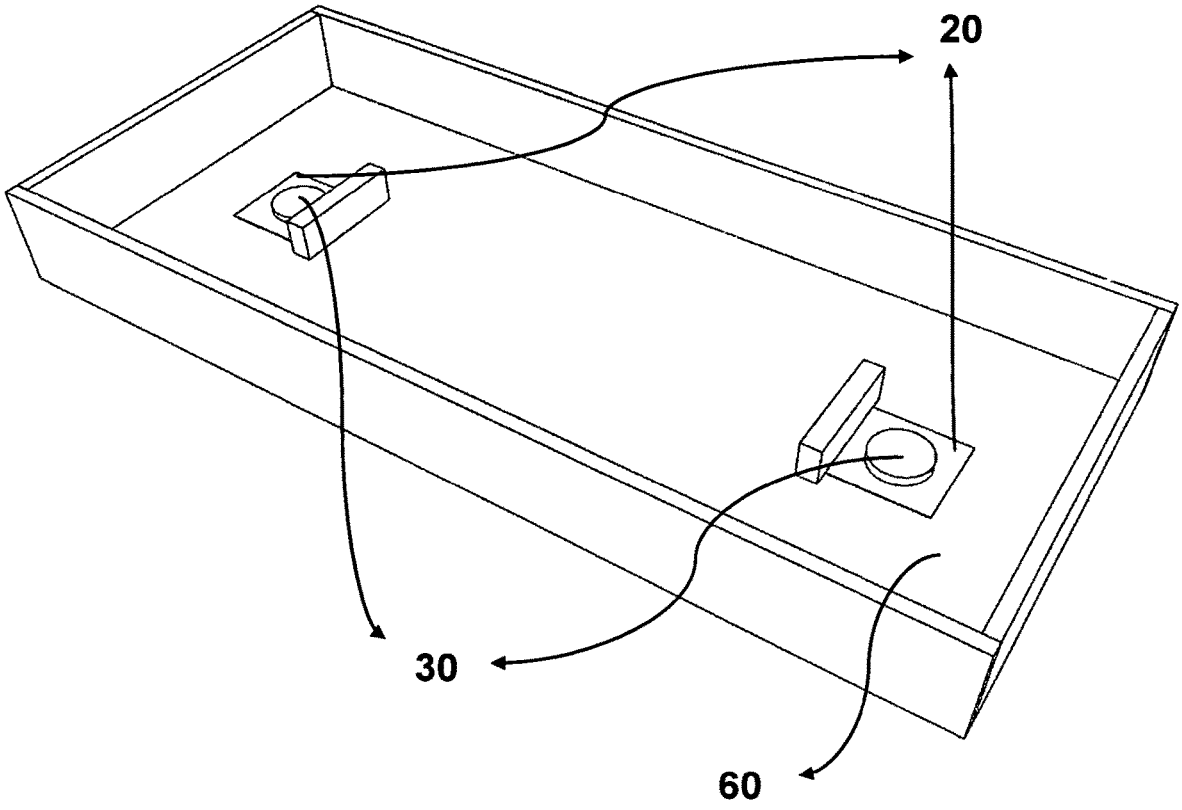
FIG. 8 is a perspective view of one embodiment of the board game, showing one embodiment of the enhanced scoring area as an elevated platform.

In another embodiment, as shown in FIG. 7, the scoring area 20 may be recessed below the playing surface 60. In such an embodiment, the enhanced scoring area 30 may be in the same plane as the scoring area 20 or may be further recessed below the surface of the scoring area or elevated above the scoring area. In the embodiment shown in FIG. 7, the enhanced scoring area is in the same plane as the playing surface, but even when elevated above the scoring area, the enhanced scoring area may alternatively be above or below the level of the playing surface.

Figure 9:
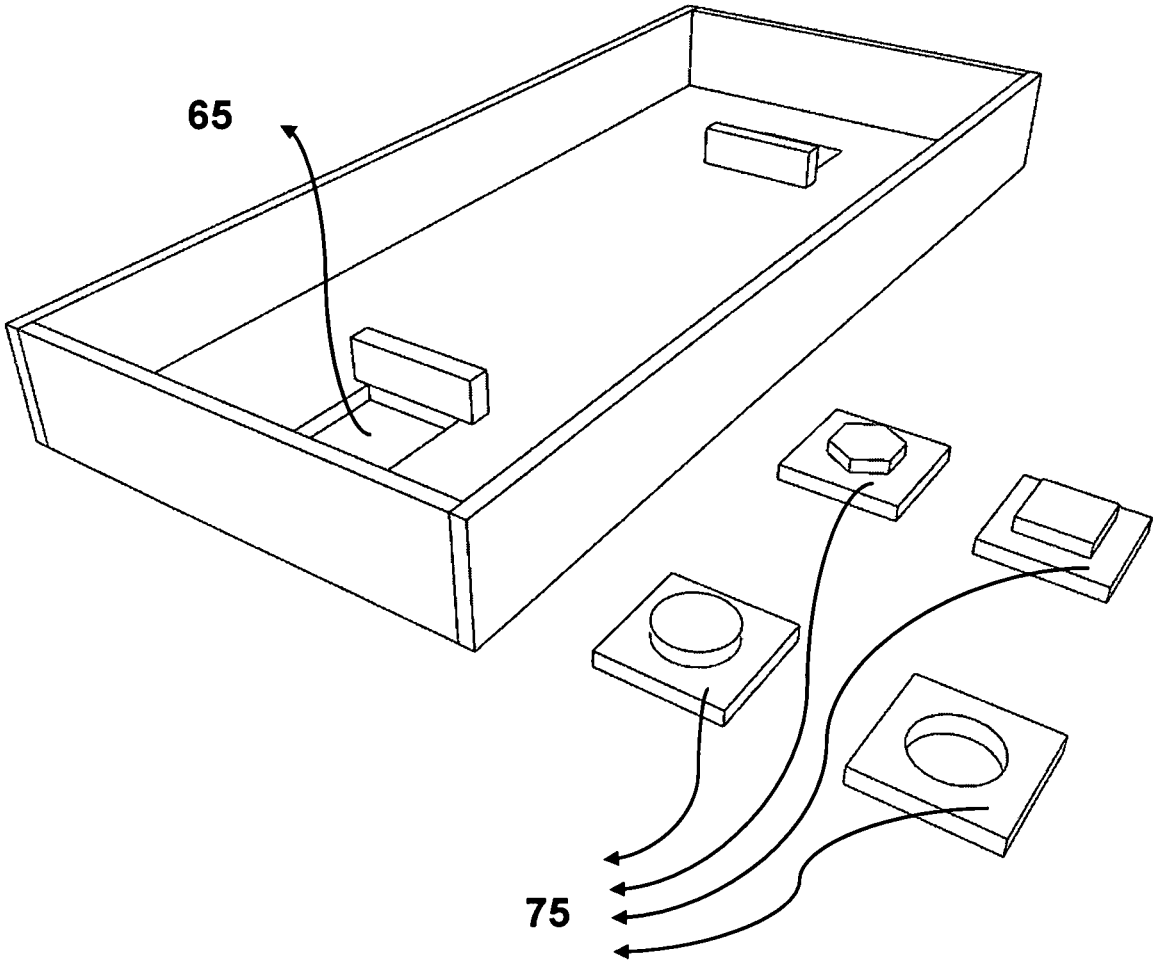
FIG. 9 is a perspective view of one embodiment of the board game, showing a recess in the scoring area and several embodiments of inserts that may be placed into the recess.

In another embodiment, the playing surface 60 may contain a recess 65 in each scoring area, wherein a variety of inserts 75 may be placed into the recess (FIG. 9). In this way, the same game board may be used with various inserts to offer a variety of configurations for the scoring areas. The following examples describe a small subset of the possible configurations for the inserts; many other configurations are possible without departing from the spirit of the invention. Examples include, but are not limited to: a square scoring area 20 with a circular enhanced scoring area 30; a circular scoring area 20 with a square enhanced scoring area 30; a triangular scoring area 20 with a hexagonal enhanced scoring area 30; a rectangular scoring area 20 with a rectangular enhanced scoring area 30. Any combination of shapes for the scoring area and enhanced scoring area is possible. Further, the insert may be configured such that when placed into the recess, the scoring area is above, below, or in the same plane as the playing surface. Further, the insert may be configured such that the enhanced scoring area is above, below, or in the same plane as the scoring area.

In another embodiment, the scoring area, whether contiguous with the playing surface or an insert that fits thereinto, contains a recessed enhanced scoring area into which a variety of inserts may be placed, changing the elevation and/or shape of the enhanced scoring area. These enhanced scoring area inserts may be in a variety of shapes including, but not limited to: a triangle, a square, a rectangle, a pentagon, a hexagon, a heptagon, an octagon, a nonagon, a decagon, a circle, an oval, an ellipse, a trapezoid, and a quadrilateral.

Each barrier may be in a permanent, fixed position or may be movable by the players. In embodiments in which the barriers are fixed, they may be so fixed with glue, screws, bolts, nails, tacks, or staples. Preferably, fixed barriers are secured with bolts, such that they may be easily replaced if damaged. In embodiments in which the barriers are movable, they may be free-floating such that they may move throughout the playing area through contact with the dice or they may be temporarily fixed in a given position for the duration of a particular game. There are many ways the barriers may be temporarily fixed in position, including, but not limited to; magnets, pegs, tenons, biscuits, adhesive, and suction cups. For example, if the playing surface is made of a ferrous metal, or contains one or more ferrous metal sections underneath the playing surface, the barriers may be temporarily fixed in a given position by incorporating magnets in one or more surfaces of the barrier. As another example, the surface area may contain a plurality of holes and the barriers may contain one or more pegs extending from the barrier on at least one surface, such that the one or more pegs may be placed into one or more holes on the playing surface to temporarily secure the barrier in a particular location. Barriers may be a wide variety of shapes including, but not limited to: a cube, a cuboid, a pyramid, a cone, a prism, a cylinder, a sphere, a polyhedron, a hemisphere, or any other three-dimensional shape. Different shaped barriers may be employed in the playing area at the same time. The heights of the side wall(s) and barrier(s) may be equal or unequal.

The apparatus is generally made of wood, plastic, metal, or other durable material and different portions of the apparatus may be made of different materials. The playing surface and the side wall(s) may be made from many types of materials, including, but not limited to: wood, metal, plastic, glass, ceramic, rubber, vinyl, leather, fabric, and foam. Padded materials may be added to the playing surface and/or to the interior surface of the side wall(s) if desired.

The word "dice" is used herein to include both the singular and the plural. Dice are available in many shapes including regular and irregular polyhedral shapes with as few as four and as many as one hundred facets. Generally, the fewer the number of facets, the more challenging it is to control the direction of the roll or bounce of the dice. As the number of facets increases, the die shape becomes more spherical and rolls in a more controllable fashion. The dice angle game of this invention is not intended to be played with marbles, balls, or other spherical objects. Accordingly, die with more than twenty facets are discouraged. Preferably, dice with regular polyhedral shapes with a number of facets selected from 4, 5, 6, 7, 8, 9, 10, 12, or 20 are used. The embodiment of the board apparatus shown uses cubic dice without any indicia. However, dice with indicia on one or more faces may be used if desired.

In another embodiment, the dice may include a projection such as a stick, a fin, a tail, a string, or the like. This projection may be gripped by the player to help control the direction of the die when tossed. The projection may include feathers, flights, flags, or fins similar to those found on darts, to help control the direction of the die when tossed.

Different apparatus layouts and arrangements of players are included in the invention. The location in which a player stands relative to the board apparatus 10 is defined as the player location 50. In one embodiment, a single scoring section is located toward one end of the playing surface. Two players are located at the opposite end of the apparatus from the scoring area in their player locations and alternate throwing the dice one at a time toward the scoring area.

Optionally in such an embodiment, the end wall or sidewall closest to the players may be omitted to facilitate throwing or rolling of the dice. Players may be required to throw the dice from behind the closest edge of the apparatus 10 or a "foul line" may be incorporated on the playing surface, behind which the players must throw the dice.

In another embodiment, two scoring sections are located at different ends of the apparatus. Two players on opposing teams playing from a player location 50 alternate throws until the dice are exhausted. Alternatively, a two-player game may be played on this embodiment, wherein the two players start at the same end of the apparatus, tossing the dice toward the same scoring area. At the end of the round, both players move to the opposite end and toss the dice toward the other scoring area. In this embodiment, a foul line may be incorporated on the playing surface, or the players may agree that the closest edge of the apparatus or a certain barrier may represent the foul line, behind which the players must throw the dice.

The horizontal surface is preferably elevated, such as a table or countertop. When a player 110 receives a turn, he throws or rolls the dice along the playing surface so that it bounces once off a side wall. He attempts to have the dice come to rest in the scoring area behind the barrier at the opposite end. When rolling the dice, the player must release it before crossing the foul line.

Figure 4:
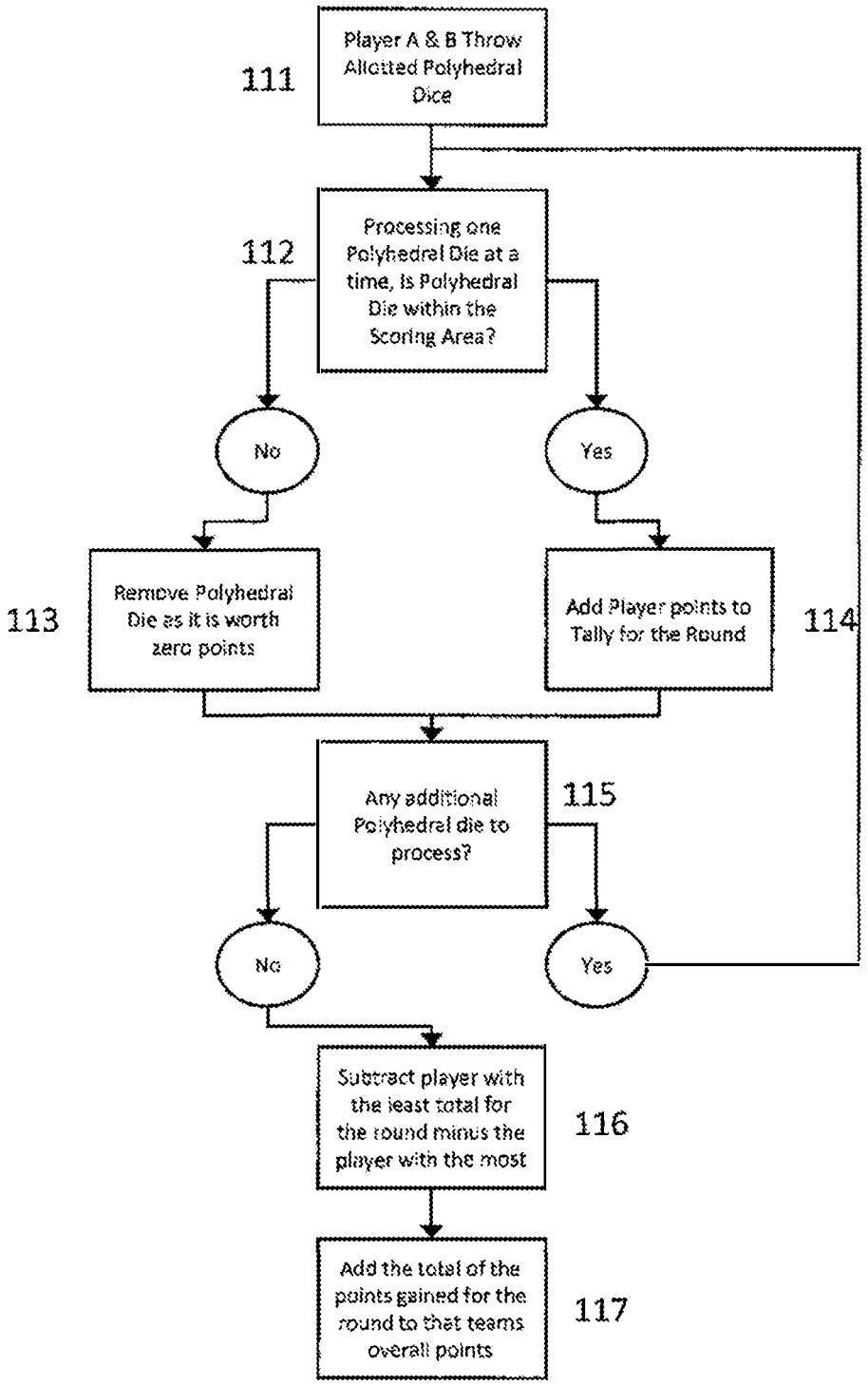
FIG. 4 is a flow chart showing a preferred cancellation scoring algorithm used in playing the board game.

After all dice have been exhausted for a round, a score is preferably determined according to the cancellation scoring algorithm illustrated in FIG. 4. In the scoring algorithm for one round as shown in FIG. 4, two players, labeled "A" and "B" throw their allotted number of dice (in Step 111) and then determine (in Step 112) if any dice are within the scoring area 20. If not, the game moves to the next round. If one or more dice are within the scoring area 20, one then begins to tally each players sum of points for the round (by repeating steps 112, 113, 114, and 115 as necessary). Once the sum of each player's points for the round is established, the player with the least amount of points for the round subtracts his points from the player with the most points for the round (in Step 116) and the resulting points are then added to that team's total points (in Step 117). In some embodiments, one or more barriers may be movable. In such embodiments, points may optionally be deducted from a player's score for knocking over a barrier with their dice.

Scoring of this embodiment of the game includes a predetermined target score, e.g., twenty-one points, which must be reached for a player or team to win the game. Victory is achieved when a player's score equals or surpasses the target score and also leads the opponent by two or more points. The game continues until victory is achieved.

Modifications and variations of both the rules of the game and of the board apparatus provided in this embodiment disclosed herein can be made without departing from the subject and spirit of the invention. For example, a different shape playing surface or variation of size, shape and location of scoring area are suitable. Alternatively, differing arrangements, sizes and shapes of the barriers on the playing surface are employed to provide a game having differing probabilities of scoring. Moreover, scoring arrangements differing from the one that is taught are used if desired. Such modifications and variations are within the scope of the invention.

I claim:

1. An apparatus for playing a dice angle game, the apparatus comprising: (a) a playing surface; (b) at least one side wall defining the outside edge of at least one portion of the playing surface; (c) at least one barrier on the playing surface; (d) at least one demarcated scoring area configured either as a platform elevated above the plane of the playing surface or recessed below the plane of the playing surface; (e) within each scoring area, a demarcated enhanced scoring area of sufficient size for at least one die to enter; and (f) a plurality of dice; wherein each scoring area is larger than the enhanced scoring area contained therein and each side wall extends at least three inches above the playing surface.

2. The apparatus of claim 1 wherein the playing surface is a shape selected from a triangle, a square, a rectangle, a pentagon, a hexagon, a heptagon, an octagon, a nonagon, a decagon, a circle, an oval, an ellipse, a trapezoid, and a quadrilateral.

3. The apparatus of claim 1 wherein the playing surface is made from at least one material selected from wood, metal, plastic, glass, ceramic, rubber, vinyl, leather, fabric, and foam.

4. The apparatus of claim 1 wherein the scoring area is a shape selected from a triangle, a square, a rectangle, a pentagon, a hexagon, a heptagon, an octagon, a nonagon, a decagon, a circle, an oval, an ellipse, a trapezoid, and a quadrilateral.

5. The apparatus of claim 1 wherein the enhanced scoring area in each scoring area is a shape selected from a triangle, a square, a rectangle, a pentagon, a hexagon, a heptagon, an octagon, a nonagon, a decagon, a circle, an oval, an ellipse, a trapezoid, and a quadrilateral.

6. The apparatus of claim 1 wherein the scoring area is a platform elevated above the plane of the playing surface.

7. The apparatus of claim 1 wherein the scoring area is recessed below the plane of the playing surface.

8. The apparatus of claim 1 wherein one or more barriers is in a fixed position.

9. The apparatus of claim 1 wherein one or more barriers is movable within the playing area.

10. The apparatus of claim 9 wherein the movable barrier may be temporarily fixed to a position through the use of at least one means selected from magnets, pegs, tenons, biscuits, adhesive, and suction cups.

11. The apparatus of claim 1 wherein said at least one barrier is made from at least one material selected from wood, metal, plastic, glass, ceramic, rubber, vinyl, leather, fabric, and foam.

12. The apparatus of claim 1 wherein each barrier is a shape selected from a cube, a cuboid, a pyramid, a cone, a prism, a cylinder, a sphere, a polyhedron, and a hemisphere.

13. The apparatus of claim 1 wherein said plurality of dice are in the shape of a regular polyhedral with a number of facets selected from 4, 5, 6, 7, 8, 9, 10, 12, and 20.

14. The apparatus of claim 1 wherein the at least one side wall is made from at least one material selected from wood, metal, plastic, glass, ceramic, rubber, vinyl, leather, fabric, and foam.

15. The apparatus of claim 1 wherein the at least one side wall has at least one surface irregularity selected from bumps, protrusions, barriers, recesses, and undulations.

16. The apparatus for playing a dice angle game, the apparatus comprising: (a) a playing surface; (b) at least one side wall defining the outside edge of at least one portion of the playing surface; (c) at least one barrier located on the playing surface; (d) at least one demarcated scoring area; (e) within each scoring area, a demarcated enhanced scoring area of sufficient size for at least one die to enter and configured either as a platform elevated above the plane of the scoring area or recessed below the plane of the scoring area; and (f) a plurality of dice; wherein each scoring area is larger than the enhanced scoring area contained therein and each side wall extends at least three inches above the playing surface.

17. The apparatus of claim 16 wherein the enhanced scoring area is a platform elevated above the plane of the scoring area.

18. The apparatus of claim 16 wherein the enhanced scoring area is recessed below the plane of the scoring area.

19. The apparatus of claim 18 further comprising one or more inserts that may be placed into said recess, thereby elevating the plane of the enhanced scoring area above the plane of the scoring area.

20. The apparatus of claim 19 wherein the insert is configured such that the elevated surface of the enhanced scoring area is a shape selected from a triangle, a square, a rectangle, a pentagon, a hexagon, a heptagon, an octagon, a nonagon, a decagon, a circle, an oval, an ellipse, a trapezoid, and a quadrilateral.

21. An apparatus for playing a dice angle game, the apparatus comprising: (a) a playing surface that includes one or more recesses; (b) one or more inserts that may be placed into said recesses, each containing a demarcated scoring area and, within each scoring area, an enhanced scoring area of sufficient size for at least one die to enter; (c) at least one side wall defining the outside edge of at least one portion of the playing surface; (d) at least one barrier on the playing surface; and (e) a plurality of dice; wherein each scoring area is larger than the enhanced scoring area contained therein and each side wall extends at least three inches above the playing surface.

22. The apparatus of claim 21 wherein said inserts are configured such that the scoring area is in the same plane as the playing surface.

23. The apparatus of claim 21 wherein said inserts are configured such that the scoring area is a platform elevated above the plane of the playing surface.

24. The apparatus of claim 21 wherein said inserts are configured such that the scoring area is recessed below the plane of the playing surface.

* * * * *